US006363998B1

(12) United States Patent
Sucker et al.

(10) Patent No.: US 6,363,998 B1
(45) Date of Patent: Apr. 2, 2002

(54) METHOD FOR SWAYING A CONTINUOUS CASTING MOLD

(75) Inventors: Jürgen Sucker, Düsseldorf; Axel Weyer, Wuppertal, both of (DE); Romeo Capotosti, Narni; Alessandro Cristallini, Roma, both of (IT)

(73) Assignees: SMS Schloemann-Siemag Aktiengesellschaft, Düsseldorf (DE); Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/403,555

(22) PCT Filed: Apr. 24, 1998

(86) PCT No.: PCT/EP98/02434

§ 371 Date: Dec. 21, 1999

§ 102(e) Date: Dec. 21, 1999

(87) PCT Pub. No.: WO98/48960

PCT Pub. Date: Nov. 5, 1998

(30) Foreign Application Priority Data

Apr. 26, 1997 (DE) ..... 197 17 778
Sep. 19, 1997 (DE) ..... 197 42 794

(51) Int. Cl.[7] ..... B22D 11/04
(52) U.S. Cl. ..... 164/478; 164/416

(58) Field of Search ..... 164/478, 416, 164/459, 418

(56) References Cited

U.S. PATENT DOCUMENTS 4,460,034 A * 7/1984 Saeki et al. ..... 164/478
4,577,277 A * 3/1986 Kamei et al. ..... 364/472
4,867,226 A * 9/1989 Uehara et al. ..... 164/478
5,579,824 A * 12/1996 Itoyama et al. ..... 164/478

FOREIGN PATENT DOCUMENTS

EP 0121622 B1 * 2/1988
EP 0618023 A1 * 3/1994

* cited by examiner

*Primary Examiner*—M. Alexandra Elve
*Assistant Examiner*—Len Tran
(74) *Attorney, Agent, or Firm*—Friedrich Kueffner

(57) ABSTRACT

A process for producing the oscillation of a continuous casting mold, especially with the use of a hydraulically driven lifting device. So that the heat transfer to the mold and the formation of the casting shell can be effectively controlled, it is proposed that, for any given strand withdrawal rate, the zero line of the mold oscillations relative to the position of the surface of the steel in the mold be moved upward and/or downward during the casting process. As a result of this measure, the quality of the cast product is effectively improved.

6 Claims, 6 Drawing Sheets

METHOD FOR SWAYING A CONTINUOUS CASTING MOLD

BACKGROUND OF THE INVENTION

1. Field of the Invention

The invention pertains to a process for producing the oscillation of a mold in a continuous casting machine, especially with the use of a hydraulically driven lifting device.

2. Description of the Related Art

Mold oscillation is an essential component of the continuous casting process of metals. It ensures the necessary lubricating action of the lubricant such as casting flux or oil and thus prevents the strand from sticking to the walls of the mold. For the continuous casting of steel, slag has become the accepted lubricant in the mold. It is formed by the melting of a casting flux, which is added to the surface of the steel in the mold in such a way that it forms a permanent cover.

The simplest technical solution, which simultaneously characterizes the predominant state of the art, consists in using a motor-driven cam to cause the continuous casting mold to oscillate. As a result, the mold oscillates sinusoidally and the frequency and amplitude can be specified in each case by adjusting the rpm's of the motor and the eccentricity of the cam.

So that the slag, acting as a lubricant, can penetrate continuously into the gap between the cast strand and the mold wall, and in order to prevent the film of lubricant from being pulled off, it is necessary to adjust the amplitude and frequency of the mold oscillations in such a way that, in the downward phase of its movement, the mold periodically overtakes the strand.

The time component of the oscillation period T during which the overtaking process $V_{mold}>V_c$ occurs during the downward movement of the mold is usually referred as "negative strip" and is described as:

$$S_n = \frac{\pi - 2 * \arcsin\left(\frac{V_c}{2 * A * \pi * n}\right)}{2 * \pi} * 100\,(\%) \tag{1}$$

where:

$V_{mold}$=the mold speed, m/s;

$V_c$=the casting rate, m/s;

A=the amplitude of the mold oscillations, m; and n=the frequency of the mold oscillations, 1/s. Corresponding to this negative strip is the so-called "heal time" $T_{heal}$:

$$T_{heal}=S_n/n$$

of each oscillation period, during which the lubricant is able to penetrate into the gap between the strand shell and the mold wall.

It is known that the negative strip, the heal time, the amplitude, and the frequency of the mold oscillations as well as the way in which the combination of the these variables is adjusted to suit the operating case in question determine the quality of the cast product and must be adapted to the properties of the heat to be cast and the selected casting flux. The selection of the oscillation parameters is an essential component of the optimization of the continuous casting process and consists essentially in the selection of an optimum combination of amplitude and frequency, such that the negative strip lies within certain limits, usually in the range of 15–40%.

The relationships described by Formulas (1) and (2) indicate that, when the mold oscillates sinusoidally, the range within which the combinations of oscillation parameters can be selected is limited. The idea of having the mold oscillate in a nonsinusoidal manner is based on the effort to separate the oscillation parameters from each other, so that the processes which occur in the continuous casting mold can be influenced more effectively.

DE 37 04 793 C2 describes a lifting device with two camshafts, which can be rotated by a drive and which are connected either to a lifting platform on which the continuous casting mold is mounted or directly to the mold itself. At least one cardan shaft is inserted into the connection between the rotary drive and the camshafts; this cardan shaft satisfies at least one of the two following conditions:

(a) the head of the joint facing away from the camshaft is mounted in such a way that its bearing can be changed; and (b) the heads of the joints are mounted so that they can be rotated with respect to each other.

The mold is caused to oscillate in a nonsinusoidal manner by the intentional use of the cardan error which occurs when the cardan shaft is not properly aligned between the shafts. By changing the height and lateral displacement of the rotary drive, the mold can be made to perform various types of nonsinusoidal motion.

It can also be derived from the specification of DE 37 04 793 C2 that, first, in order to obtain a strand with a surface as free as possible of chatter marks, it is necessary to keep the negative strip as small as possible. Second, it is said to be favorable for the strand withdrawal rate curve to intersect the mold speed curve in the fast descent phase. This means that the time during which the continuous casting mold and the strand are both moving in the same direction is short. As a result, however, a long negative strip is created, which is in turn unfavorable because of the formation of chatter marks.

EP 0,121,622 B1 describes a process for continuous casting with the use of a mold supported in a frame, the mold being made to oscillate by an electrohydraulic servo device. The oscillation-producing device is operated according to a preselected oscillation amplitude signal from a function generator at a frequency which is higher than the natural frequency of the oscillation device.

EP 0,618,023 A1 discloses a process for continuous casting in which a mold with comparatively long side walls and comparatively narrow transverse walls is used. Simultaneously with the oscillation of the mold, the side walls of the mold are moved away from the cast strand by a short distance in the transverse direction during the time phase of each oscillation in which the difference between the mold speed and the strand withdrawal rate exceeds a predetermined value. During the rest of the time, i.e., the time during which the strand and the mold are moving at approximately the same speed, the side walls are moved back again toward the strand. As a result of the alternating expansion and contraction of the mold, it is said that the tensile and compressive forces acting on the strand shell are reduced. The depth of the oscillation marks is thus decreased, and there is less liquation in the groove.

EP 0,618,023 A1 also proposes mold oscillation without an overtaking phase. In this case, the slag is allowed to penetrate into the gap between the strand and the mold wall as a result of the alternating widening and constricting of the mold.

An essential feature of the known course of the sinusoidal and nonsinusoidal speed curves is that, at a given oscillation frequency and amplitude, the course of the mold speed and distance curves is always the same during the time between two successive overtakings of the strand by the downward-moving mold.

For the thin-slab process with slab thicknesses of less than 100 mm, casting rates of more than 4 m/min are normal. According to Formula (1), the lifting frequencies of the mold at which the conventional values for negative strip are obtained are correspondingly high, i.e., 400–450 strokes/min. Because of the short periods of 0.13–0.15 s per oscillation at these high frequencies, deviations in the oscillation curve from a sine wave have hardly any effect on lubrication behavior or on the formation of the casting shell in the mold. It is therefore impossible in this way to achieve any improvement in the surface quality of the cast product. Test castings have confirmed this.

The disadvantage of the known nonsinusoidal curves is therefore to be seen in the fact that they are able to affect the behavior of the lubricant and the casting shell formation process in such a way as to improve the quality of the cast product only in the range of low casting rates and mold oscillation frequencies. When continuous casting is carried out at high strand withdrawal rates and high mold oscillation frequencies, however, such as those used in the thin-slab process, for example, it is therefore necessary to adopt a new approach.

SUMMARY OF THE INVENTION

Proceeding from this state of the art, the invention is based on the task of creating an oscillatory motion of the continuous casting mold which differs from any of those used in the past and which makes it possible to control heat transfer in the mold and the formation of the casting shell and thus to obtain cast products of a quality superior to those produced with sinusoidal or non-sinusoidal oscillations of comparable frequency and amplitude.

This task is accomplished by the invention in a process of the aforementioned kind in that, for any given strand withdrawal rate, the zero line of the mold oscillations relative to the position of the steel surface in the mold is moved upward and/or downward during the casting process.

The invention thus offers the advantageous possibility of being able to vary the course of the oscillation curve of the continuous casting mold over a wide range with respect to the form of its oscillation, its frequency, and its amplitude and also to arrive at the optimum relationship between, for example, negative strip, heal time, and frequency.

According to one embodiment of the invention, the zero line of a series of successive mold oscillations shifts periodically upward and downward relative to the position of the surface of the steel in the mold. By the use of a sufficiently high overtake frequency, it is therefore possible in this way to ensure reliable lubrication. It is also possible at the same time to introduce an oscillation component with a much lower frequency into the "mold-strand" system. Because this low-frequency component makes sufficient time available, it is possible to influence and guide the melting behavior of the casting flux, the heat transfer near the steel surface in the mold, and the formation of the strand shell in a significant manner by adjusting the frequency, amplitude, and form of this slow oscillation. This leads to significant improvement in the quality of the cast product and to an increase in operating safety.

It is proposed according to the invention that, for a given strand withdrawal rate, the zero line of the mold oscillations be shifted over the course of several successive individual oscillations, each of which corresponds to the motion of the mold from one dead center point to the other and back again, by successive changes in the mold speed curve.

One embodiment of the process according to the invention provides that the mold oscillation is induced by the superposition of at least two independent oscillations, which differ from each other with respect to their speed curve alone, their frequency alone, the combination of the two, or the combination of the two plus their amplitude.

In a further elaboration of the invention, it is proposed that the frequency of at least two successive identical mold oscillations be lower than the frequency at which the mold overtakes the strand during its downward movement.

The implementation of the process can be advantageously facilitated by supporting the mold in a frame and by mounting this frame on a lifting platform, so that both the frame and the lifting platform can be driven to oscillate in different ways independently of each other. As a result, two different oscillations, each with different speed curves and/or frequencies and/or amplitudes, can be superposed on each other.

The process can be applied at least during one and/or more casting phases of the casting process, as a result of which the heat transfer in the mold and the formation of the strand can be controlled in an extremely flexible manner. The quality of the cast product can thus be effectively improved.

Figure 1:
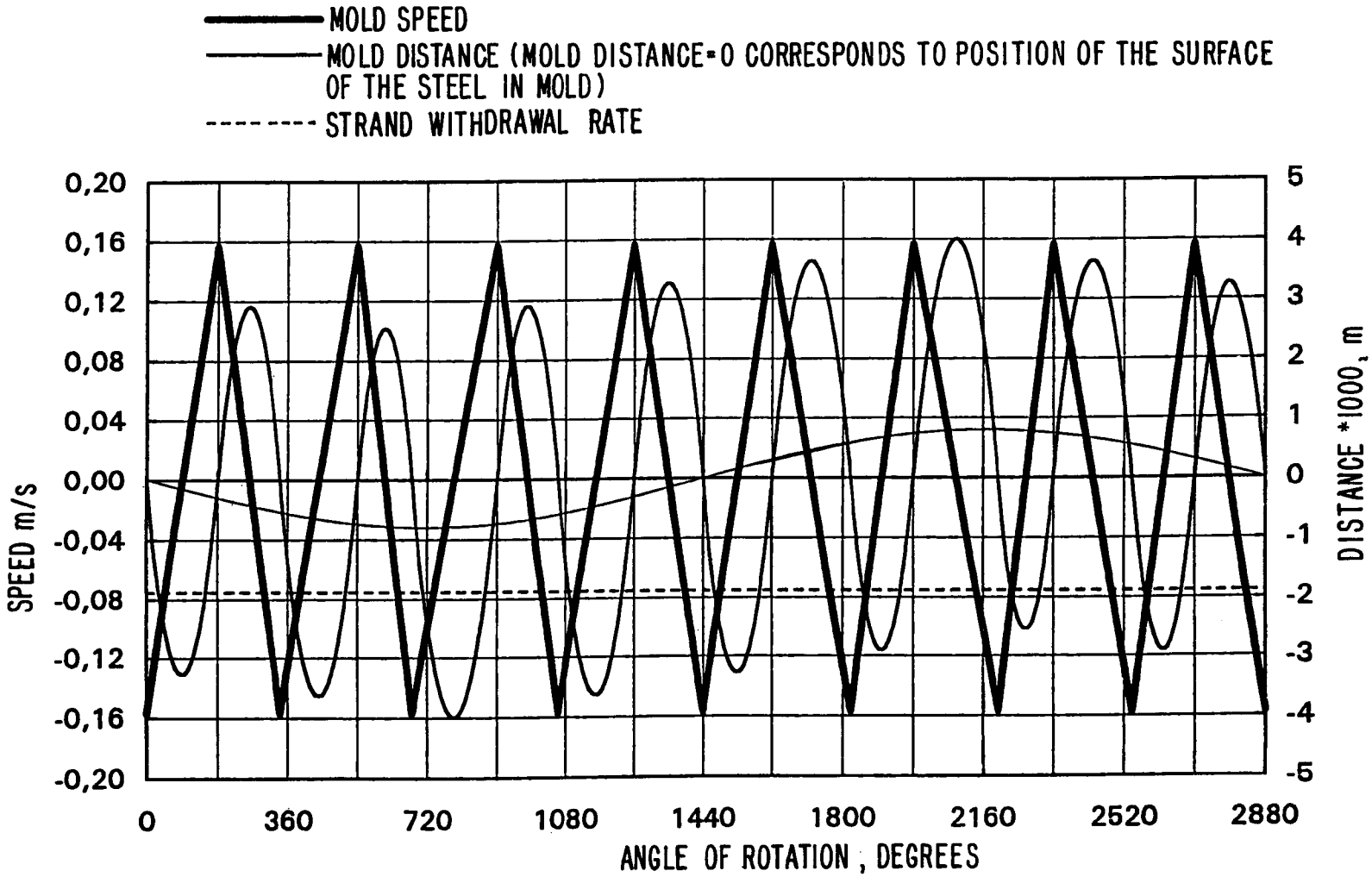
FIG. 1 shows the course of the mold speed and distant curves as well as the constant strand withdrawal rate for mold oscillation consisting of the sequence of eight successive, different oscillations.
Figure 2:
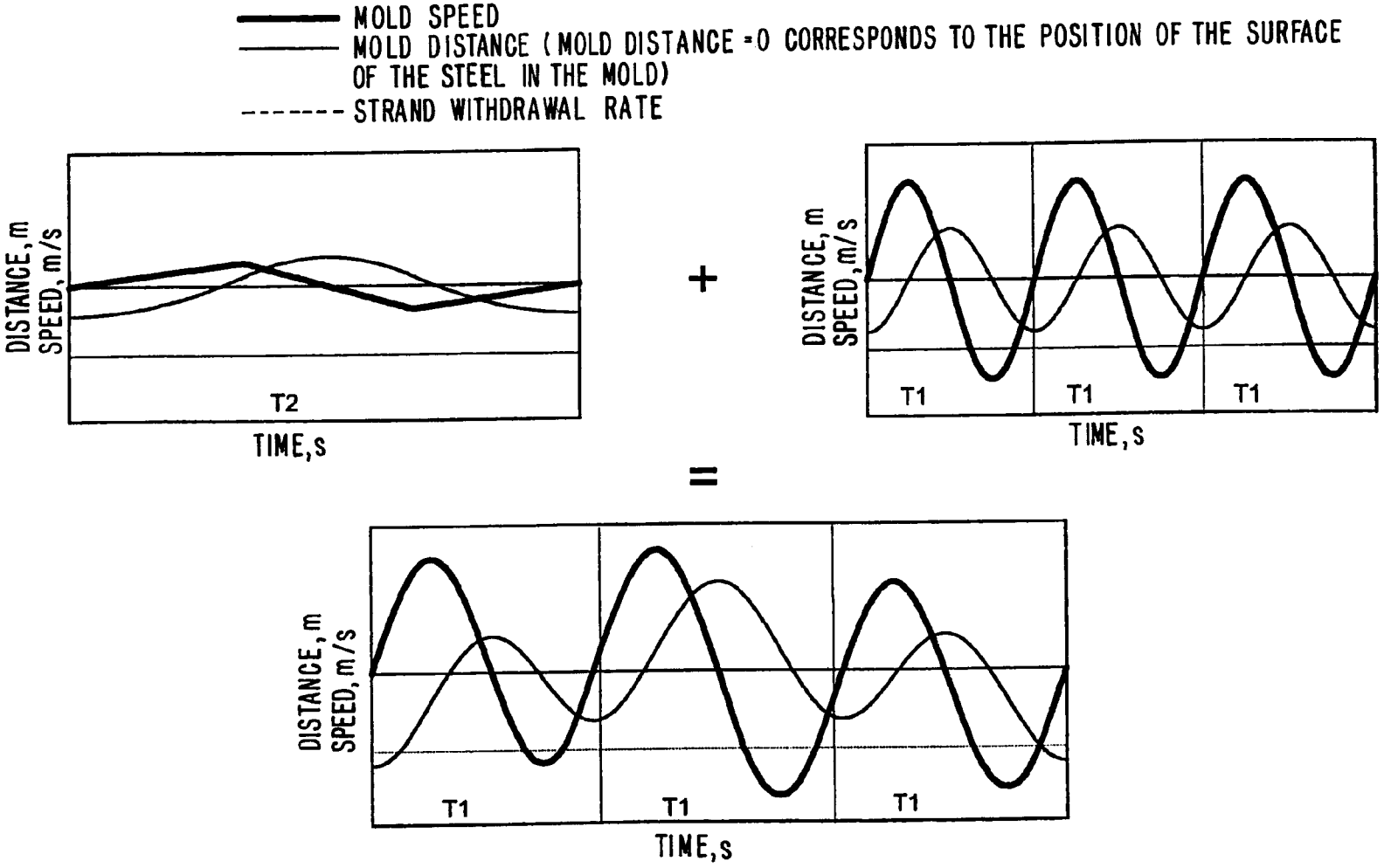
FIGS. 2–6 show examples of possibilities for mold oscillations achievable by the superosition of at least two independent oscillations with different oscillation parameters.
Figure 3:
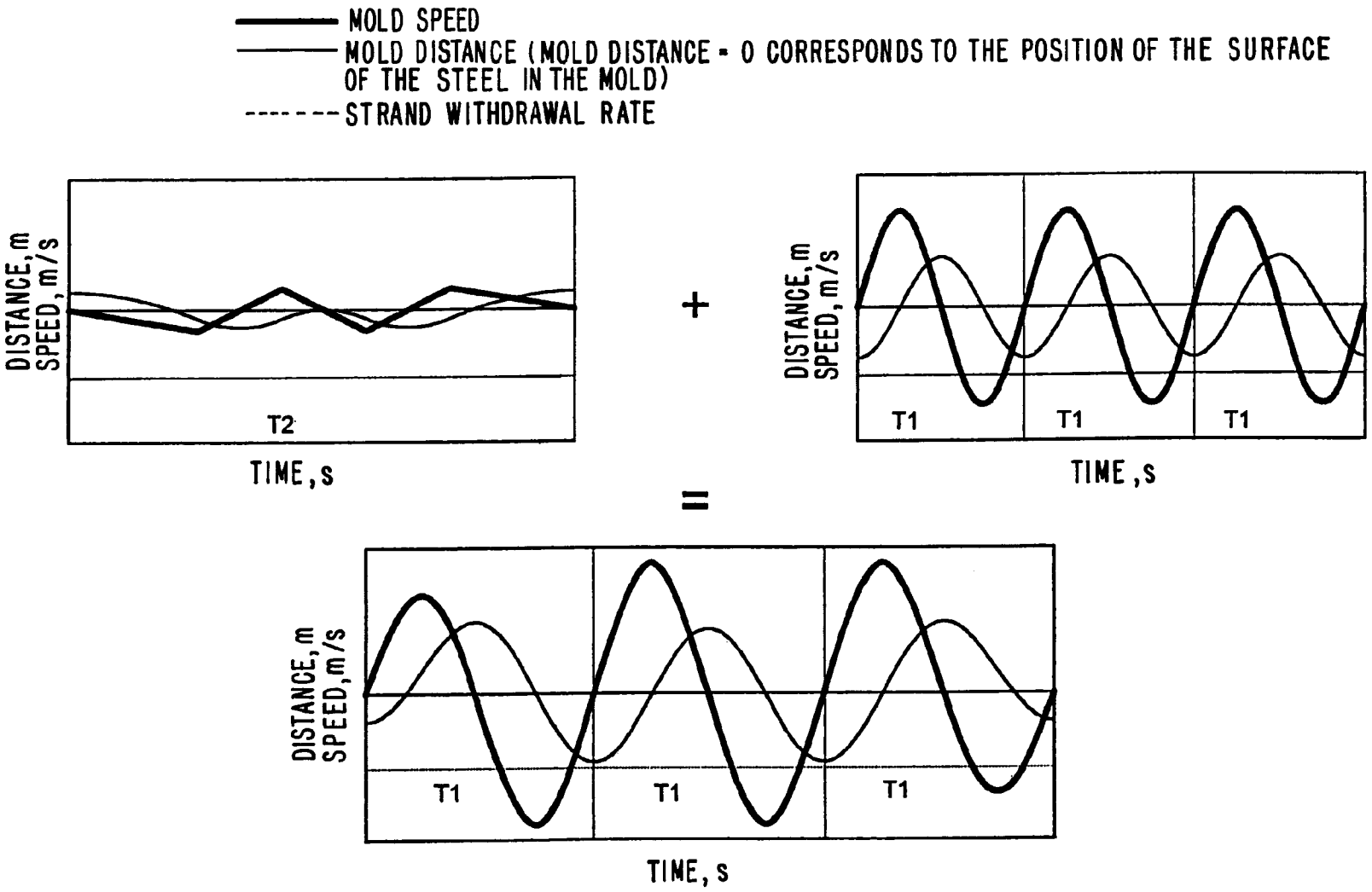
Figure 4:
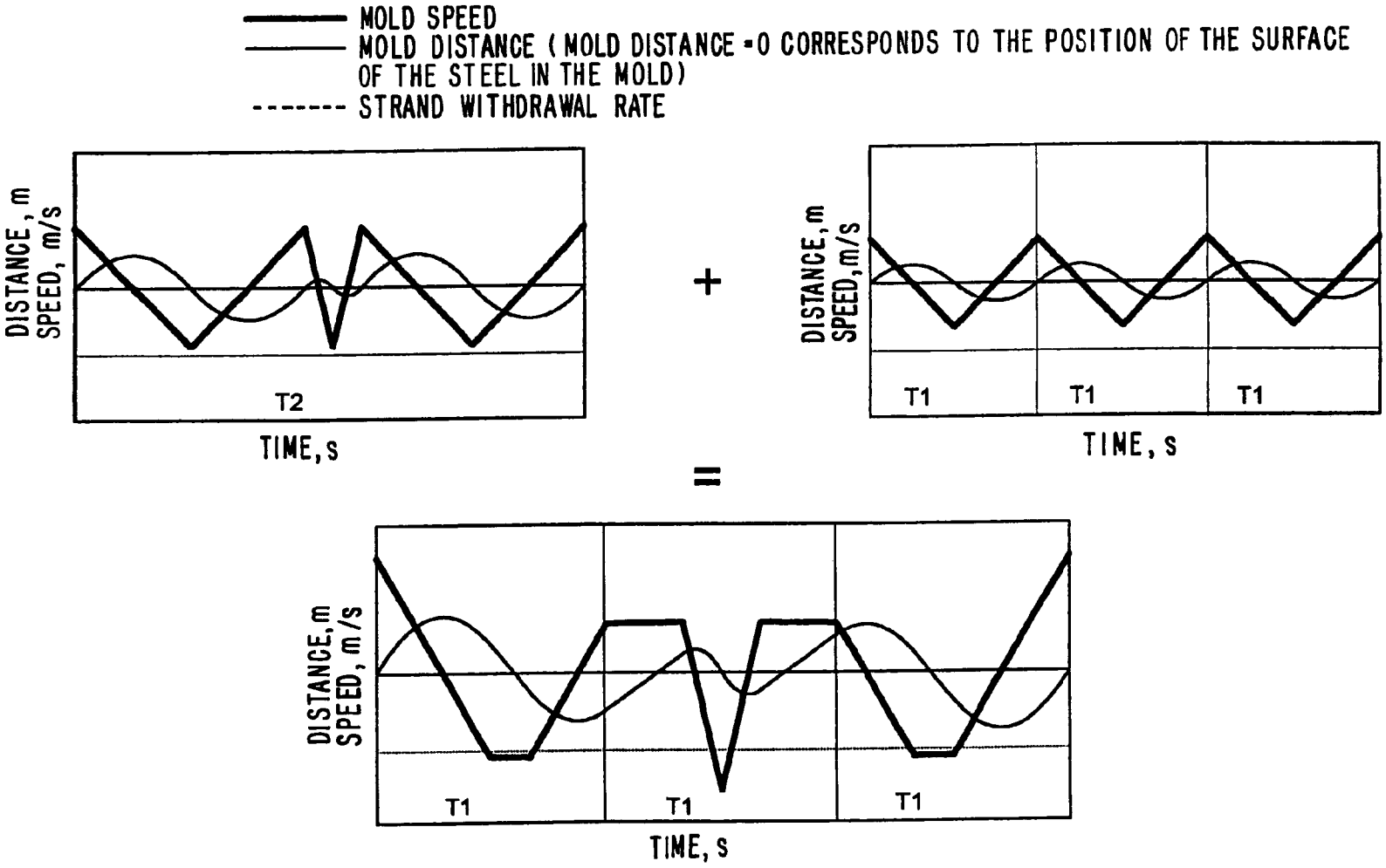

Exemplary embodiments of the invention and especially the oscillation curves are shown in the drawings.

DESCRIPTION OF THE PREFERRED EMBODIMENTS

FIG. 1 shows the course of the mold speed and distance curves as well as the constant strand withdrawal rate for a mold oscillation which consists of a sequence of eight successive, different oscillations. At an oscillation frequency of 360 strokes/min and an amplitude of +3.2 mm, an additional periodic displacement of +0.8 mm of the zero line of the mold oscillations is achieved by periodically reducing the time of the maximum speed of the down-ward-moving mold by 10° in each case over the course of two successive oscillations and then by increasing it again by 10° each time in the two following oscillations.

The example presented shows that a very small successive periodic change in the course of the mold speed, which exerts no significant effect on the negative strip, is sufficient to bring about a displacement of the zero line of the mold oscillations which is detectable with respect to its amplitude and its effects on the casting process.

FIGS. 2–6 show examples of the nearly unlimited range of resulting possibilities for mold oscillations which can be achieved by the superposition of at least two independent oscillations with different oscillation parameters.

The two upper panels show two independent oscillation parameters; the curves in the panel on the right have three times the frequency of those in the panel on the left.

The resultant of superposing the two independent curves gives the distance and speed curves in the bottom panel.

Figure 5:
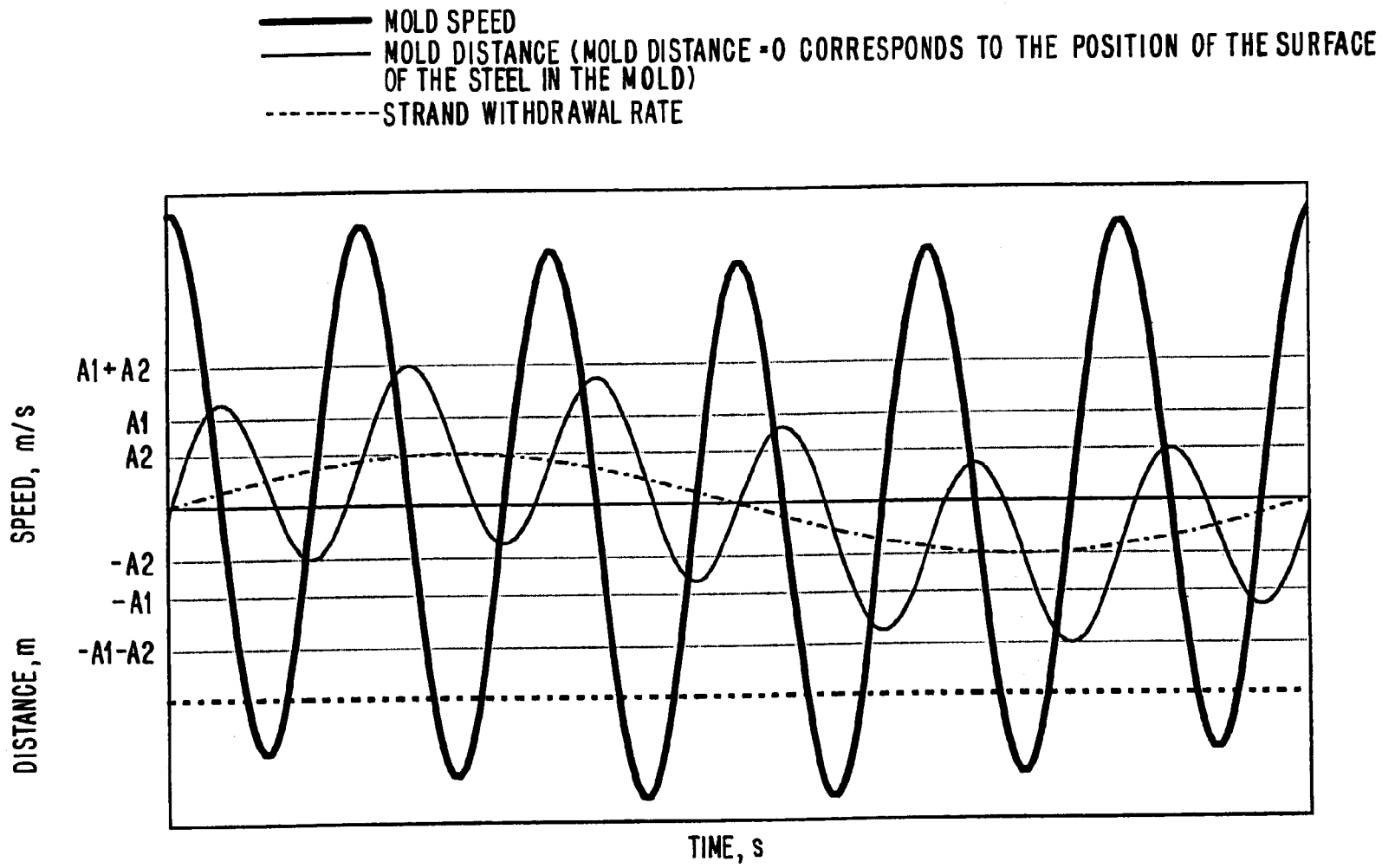

FIG. 5 shows the oscillation curve of a continuous casting mold according to the invention. It was used during the casting of a stainless, austenitic steel on a thin-slab casting machine. This oscillation curve is the result of the superposition of two sine curves with amplitudes of $A_1$ and $A_2$ and corresponding frequencies of $f_1$ and $f_2=f_1/6$. The zero line of the 6 successive nonidentical oscillations of this oscillation curve shifts once in the downward direction and once in the upward direction.

With a curve of this type, the casting flux melts more uniformly and the lubricant then penetrates more uniformly into the casting gap.

As a result of the superposed oscillations, the slag cools to a greater degree, which means that the amount of heat transferred to the mold wall is reduced. As a result of these two advantageous effects, the formation of depressions on the surface of the strand during the casting of stainless, austenitic steel is prevented. In test castings at rates of 3.8–4.2 m/min and at frequencies $f_1$ of 240–270 strokes/min and $f_2=f_1/6=42–45$ strokes/min, the formation of longitudinal depressions on the strand was completely prevented. An evaluation of the signals from thermocouples in the mold plates confirmed that the heat exchange near the surface of the steel in the mold was on a lower level and was much more stable when the oscillation curve according to the invention was used.

Figure 6:
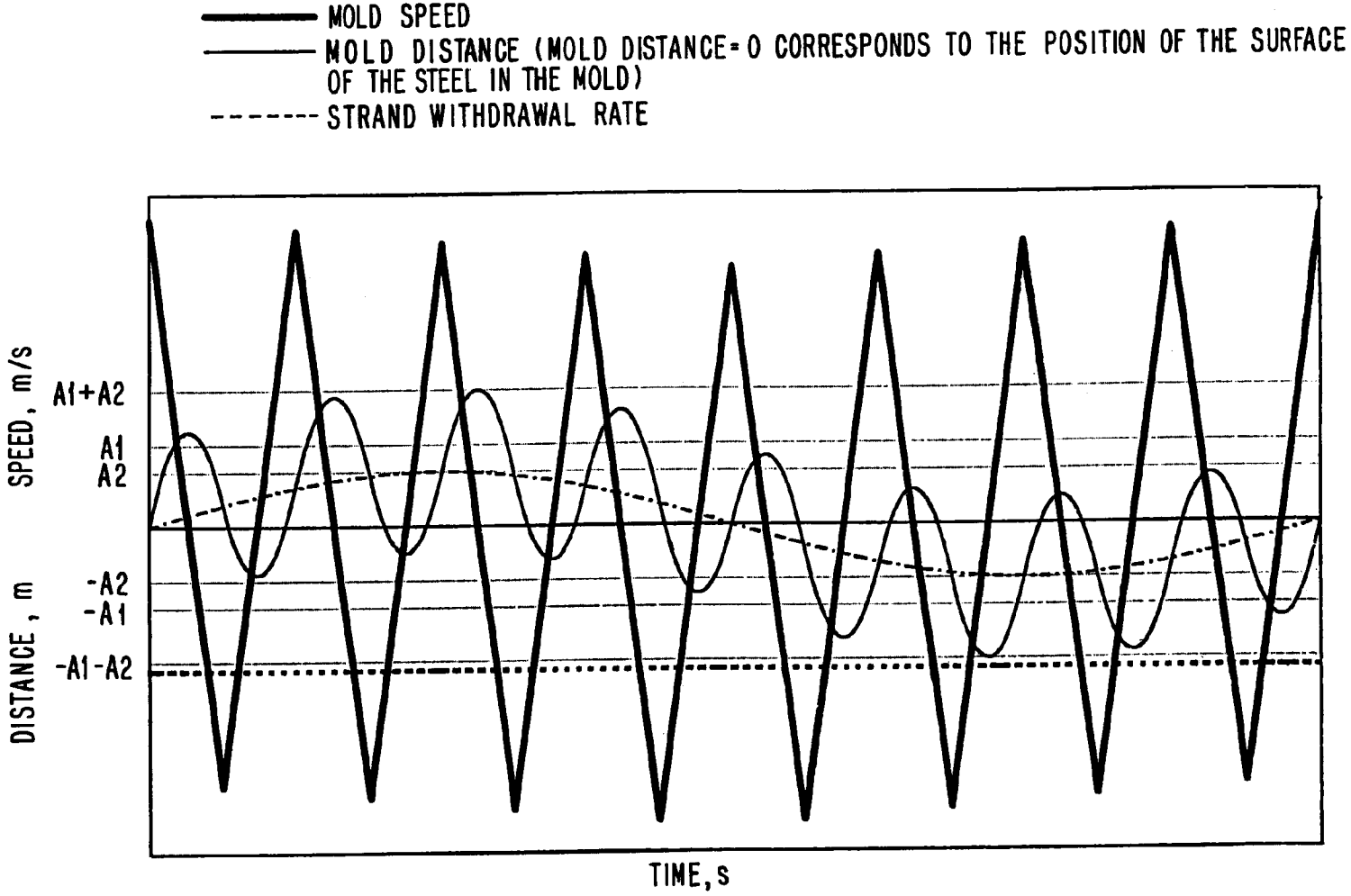

Another exemplary embodiment of oscillation curves according to the invention is shown in FIG. 6. This oscillation curve is the result of the superposition of two parabolic motion curves with the corresponding amplitudes $A_1$ and $A_2$ and the frequencies $f_1$ and $f_2=f_1/8$. In this case, the speed curve consists of straight segments. The advantage of this curve is not only that it provides the previously mentioned positive effects on the quality of the cast product but also that it is determined by a much smaller number of reference points, which means that the effort required to program the control algorithms is reduced correspondingly.

What is claimed is:

1. Process for producing an oscillation of a continuous casting mold, the process comprising, for any given strand withdrawal rate, moving a zero line of the mold oscillations, defined as a line connecting points at half a stroke length of a movement of the mold from one dead center point to the other and back, respectively, of a series of mold oscillations when plotted as a function of an angle of rotation, relative to a position of a surface of a steel in the mold, up and/or down during the casting process, further comprising shifting the zero line of the mold oscillations relative to the position of the surface of the steel in the mold periodically upward and downward over the course of a series of successive mold oscillations.

2. Process according to claim 1, wherein the zero line of the mold oscillations is displaced by successive changes in the mold speed curve over the course of several successive individual oscillations, each of which corresponds to the movement of the mold from one dead center point to the other and back again.

3. Process according to claim 1, wherein the mold oscillation is brought about by the superposition of at least two independent oscillations, generated by at least two independent oscillators, wherein the at least two independent oscillations differ with respect to the course of their speed curve alone, their frequency alone, the combination of the two, or the combination of the two plus their amplitude.

4. Process according to claim 1, wherein the frequency of at least two successive identical mold oscillations is lower than the frequency at which the mold overtakes the strand during its downward movement.

5. Process according to claim 1, wherein to produce superposable oscillations with different speed curves and/or frequencies and/or amplitudes, the mold is supported in a frame, the frame being mounted on a lifting platform, and in that both the frame and the lifting platform can be driven to perform oscillations which are independent of each other.

6. Process according to claim 1, wherein the mold oscillations are generated by a hydraulically driven lifting device.

* * * * *